US008540354B2

(12) United States Patent
Shimizu et al.

(10) Patent No.: US 8,540,354 B2
(45) Date of Patent: Sep. 24, 2013

(54) LIQUID EJECTION HEAD

(75) Inventors: Seiji Shimizu, Ogaki (JP); Yoshihumi Suzuki, Ena (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/405,013

(22) Filed: Feb. 24, 2012

(65) Prior Publication Data

US 2012/0242751 A1 Sep. 27, 2012

(30) Foreign Application Priority Data

Mar. 24, 2011 (JP) ..... 2011-065428

(51) Int. Cl.
*B41J 2/175* (2006.01)

(52) U.S. Cl.
USPC ..... 347/85

(58) Field of Classification Search
USPC ..... 347/85
See application file for complete search history.

(56) References Cited

U.S. PATENT DOCUMENTS

| | | | | |
|---|---|---|---|---|
| 6,783,207 | B1 | 8/2004 | Seto et al. | |
| 6,808,254 | B2 * | 10/2004 | Sakaida et al. | 347/71 |
| 7,384,128 | B2 * | 6/2008 | Sheahan et al. | 347/42 |
| 7,798,628 | B2 * | 9/2010 | Kataoka et al. | 347/94 |
| 2007/0132815 | A1 * | 6/2007 | Sakaida | 347/85 |

FOREIGN PATENT DOCUMENTS

| | | | |
|---|---|---|---|
| JP | 2004-284254 | A | 10/2004 |
| JP | 2007-160566 | A | 6/2007 |

* cited by examiner

*Primary Examiner* — Matthew Luu
*Assistant Examiner* — Michael Konczal
(74) *Attorney, Agent, or Firm* — Baker Botts L.L.P.

(57) ABSTRACT

A liquid ejection head including a flow path unit is provided. The flow path unit includes a plurality of liquid ejection ports arranged in a matrix form in a two-dimensional area of a parallelogram, and a plurality of pressure chambers communicating with the plurality of liquid ejection ports, respectively, and each pressure chamber being long in a first direction. The flow path unit is long in a second direction. Each of the pressure chambers has a length in the second direction larger than a length in a direction orthogonal to the second direction. The plurality of pressure chambers are arranged in a matrix form in a substantially same area as the two-dimensional area.

11 Claims, 8 Drawing Sheets

LIQUID EJECTION HEAD

CROSS-REFERENCE TO RELATED APPLICATION

This application claims priority from Japanese Patent Application No. 2011-065428, filed on Mar. 24, 2011, the entire subject matter of which is incorporated herein by reference.

TECHNICAL FIELD

Aspects of the present invention relate to a liquid ejection head including a plurality of pressure chambers arranged in a matrix form.

BACKGROUND

There has been known a head which ejects liquid such as ink and includes a plurality of pressure chambers arranged in a matrix form in a two-dimensional area having a parallelogram shape. In such a head, a longitudinal direction of each pressure chamber is aligned in a shorter direction of the head.

If the longitudinal direction of the pressure chambers is arranged in the shorter direction of the head, the area in which the pressure chambers are arranged in the matrix form becomes larger, so that it is difficult to reduce the entire size of the head.

SUMMARY

Accordingly, an aspect of the present invention provides a liquid ejection head including a plurality of pressure chambers arranged such that the entire size of the head is compact.

According to an illustrative embodiment of the present invention, there is provided a liquid ejection head comprising: a flow path unit which includes: a plurality of liquid ejection ports arranged in a matrix form in a two-dimensional area of a parallelogram; and a plurality of pressure chambers communicating with the plurality of liquid ejection ports, respectively, and each pressure chamber being long in a first direction. The flow path unit is long in a second direction. Each of the pressure chambers has a length in the second direction larger than a length in a direction orthogonal to the second direction. The plurality of pressure chambers are arranged in a matrix form in a substantially same area as the two-dimensional area.

According to the above configuration, the plurality of pressure chambers are arranged in the matrix form such that each pressure chamber is long in the longitudinal direction (second direction) of the flow path unit. Thereby, a width of the area in which the pressure chambers are arranged is reduced in the shorter direction of the flow path unit, so that the entire size of the head can be compact.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1:
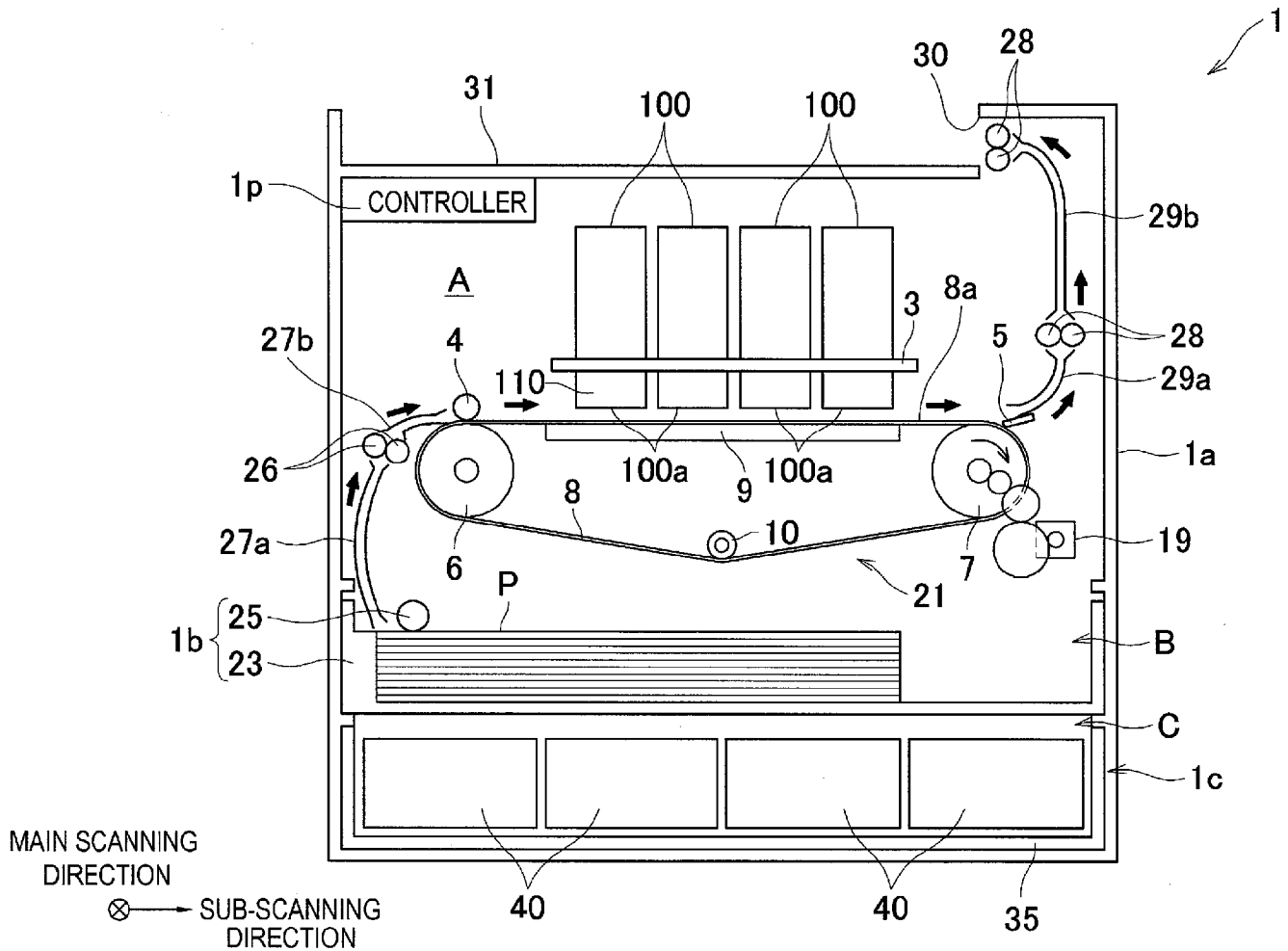
FIG. 1 is a schematic side view showing an internal structure of an inkjet printer including an inkjet head according to an illustrative embodiment of the present invention.

Hereinafter, illustrative embodiments of the present invention will be described with reference to the accompanying drawings.

First, an overall configuration of an inkjet printer 1 including an inkjet head 100 according to an illustrative embodiment of the present invention is described with reference to FIG. 1.

The printer 1 has a rectangular parallelepiped housing 1*a*. A top plate upper part of the housing 1*a* is provided with a sheet discharge part 31. In the below descriptions, an internal space of the housing 1*a* is divided into spaces A, B and C in order from the upper. The spaces A, B accommodate a sheet conveyance path continuing to the sheet discharge part 31. In the space A, a sheet P is conveyed and an image is recorded on the sheet P. In the space B, a sheet feeding operation is performed. The space C accommodates an ink cartridge 40 which is an ink supply source.

In the space A, four inkjet heads 100, a conveyance unit 21 which conveys the sheet P, a guide unit (which will be described later) which guides the sheet P, and the like are provided. In the upper part of the space A, a controller 1*p* is arranged which controls operations of respective units of the printer 1 including the above mechanisms and controls he entire operation of the printer 1.

The controller 1*p* controls a preparation operation relating to a recording, feed/convey/discharge operations of the sheet P, an ink ejection operation synchronous with the conveyance of the sheet P, a recovering and maintaining operation of ejection performance (maintenance operation) and the like such that an image is recorded on the sheet P, based on image data supplied from the outside.

The controller 1*p* has a ROM (Read Only Memory), a RAM (Random Access Memory: including non-volatile RAM), an ASIC (Application Specific Integrated Circuit), an I/F (Interface), an I/O (Input/Output Port) and the like, in addition to a CPU (Central Processing Unit) which is a calculation processing device. The ROM stores therein programs which are executed by the CPU, a variety of fixed data and the like. The RAM temporarily stores therein data (for example, image data) which is necessary when executing the programs. In the ASIC, rewriting of image data, rearrangement (signal processing and image processing) and the like are performed. The I/F transmits and receives data to and from a higher-level apparatus. The I/O inputs and outputs detection signals of various sensors.

Each of the heads 100 is a line-type head having a substantially rectangular parallelepiped shape which is long in a main scanning direction (second direction). The four heads 100 are arranged in a sub-scanning direction at a predetermined distance and are supported to the housing 1*a* via a head frame 3. The head 100 includes a flow path unit 110 and four actuator units 120 (refer to FIG. 2). When recording an image, magenta, cyan, yellow and black inks are ejected from lower surfaces (ejection surfaces 100*a*) of the four heads 100, respectively. The detailed configuration of the head 100 will be described later.

As shown in FIG. 1, the conveyance unit 21 has belt rollers 6, 7, an endless conveyance belt 8 which is wound around the belt rollers 6, 7, a nip roller 4 and a separation plate 5, which are arranged on an outer side of the conveyance belt 8, a platen 9 which is arranged on an inner side of the conveyance belt 8, and the like.

The belt roller 7 is a driving roller and is rotated in a clockwise direction of FIG. 1 as a conveyance motor 19 is driven. As the belt roller 7 is rotated, the conveyance belt 8 travels in a thick arrow direction of FIG. 1. The belt roller 6 is a driven roller and is rotated in the clockwise direction of FIG. 1 as the conveyance belt 8 travels. The nip roller 4 is arranged to face the belt roller 6 and presses the sheet P, which is fed from an upstream side guide unit (which will be described later), onto an outer peripheral surface 8*a* of the conveyance belt 8. The separation plate 5 is arranged to face the belt roller 7, separates the sheet P from the outer peripheral surface 8*a* and guides the same to a downstream side guide unit (which will be described later). The platen 9 is arranged to face the four heads 100 and supports a loop upper part of the conveyance belt 8 from the inner side thereof. Thereby, a predetermined gap suitable for the image recording is formed between the outer peripheral surface 8*a* and the ejection surfaces 100*a* of the heads 100.

The guide unit includes the upstream side guide part and downstream side guide part that are arranged with the conveyance unit 21 being interposed therebetween. The upstream side guide part has two guides 27*a*, 27*b* and a pair of conveyance rollers 26. The upstream side guide part is provided along a conveyance path from a sheet feeding unit 1*b* (which will be described later) to the conveyance unit 21. The downstream side guide part has two guides 29*a*, 29*b* and two pairs of conveyance rollers 28. The downstream side guide part is provided along a conveyance path from the conveyance unit 21 to the sheet discharge part 31.

In the space B, the sheet feeding unit 1*b* is provided. The sheet feeding unit 1*b* has a sheet feeding tray 23 and a sheet feeding roller 25. The sheet feeding tray 23 is detachably attached to the housing 1*a*. The sheet feeding tray 23 is a box which is opened upward and accommodates therein the sheets P having a plurality of sizes. The sheet feeding roller 25 feeds an uppermost sheet P in the sheet feeding tray 23, to the upstream side guide part.

In the spaces A and B, as described above, the sheet conveyance path from the sheet feeding unit 1*b* to the sheet discharge part 31 via the conveyance unit 21 is formed. When the controller 1*p* drives the sheet feeding roller 25, the conveyance rollers 26, 28, the conveyance motor 19 and the like, based on a recording instruction, the sheet P is first fed from the sheet feeding tray 23. The sheet P is fed to the conveyance unit 21 by the conveyance rollers 26. When the sheet P passes below the respective heads 100 in the sub-scanning direction, the inks are ejected from the respective ejection surfaces 100*a*, so that a color image is formed on the sheet P. Then, the sheet P is separated by the separation plate 5 and is conveyed upward by the two conveyance rollers 28. Also, the sheet P is discharged to the sheet discharge part 31 through an upper opening 30.

In the meantime, the sub-scanning direction is a direction which is parallel with the conveyance direction of the sheet P by the conveyance unit 21 and the main scanning direction is a direction which is parallel with a horizontal surface and is orthogonal to the sub-scanning direction.

In the space C, an ink unit 1*c* is detachably attached to the housing 1*a*. The ink unit 1*c* has a cartridge tray 35 and four cartridges 40 which are accommodated in line in the cartridge tray 35. The respective cartridges 40 supply inks to the corresponding heads 100 through ink tubes.

In the below, the configuration of the head 100 is more specifically described with reference to FIGS. 2 to 5. The head 100 includes an upper structure and a lower structure of a flow path forming member. The upper structure communicates with the cartridge 40 and temporarily stores therein the ink. The lower structure includes the flow path unit 110 and communicates with the upper structure. A lower surface of the lower structure is the ejection surface 100*a* and the ink is ejected through ejection ports 109 (which will be described later). Four parallelogram-shaped actuator units 120 are attached on an upper surface of the flow path unit 110. Each actuator unit 120 is electrically connected to a circuit substrate, which is arranged at the upper part of the upper structure, by a flexible printed circuit (FPC) 150. In the circuit substrate, a control signal from the outside is processed, and a driving signal based on the control signal is supplied from a driver IC on the FPC 150 to the actuator unit 120. In the meantime, the FPCs 150 are drawn out alternately with respect to the main scanning direction from the actuator units 120 to the outside of the flow path unit 110 toward the sub-scanning direction.

Figure 2:
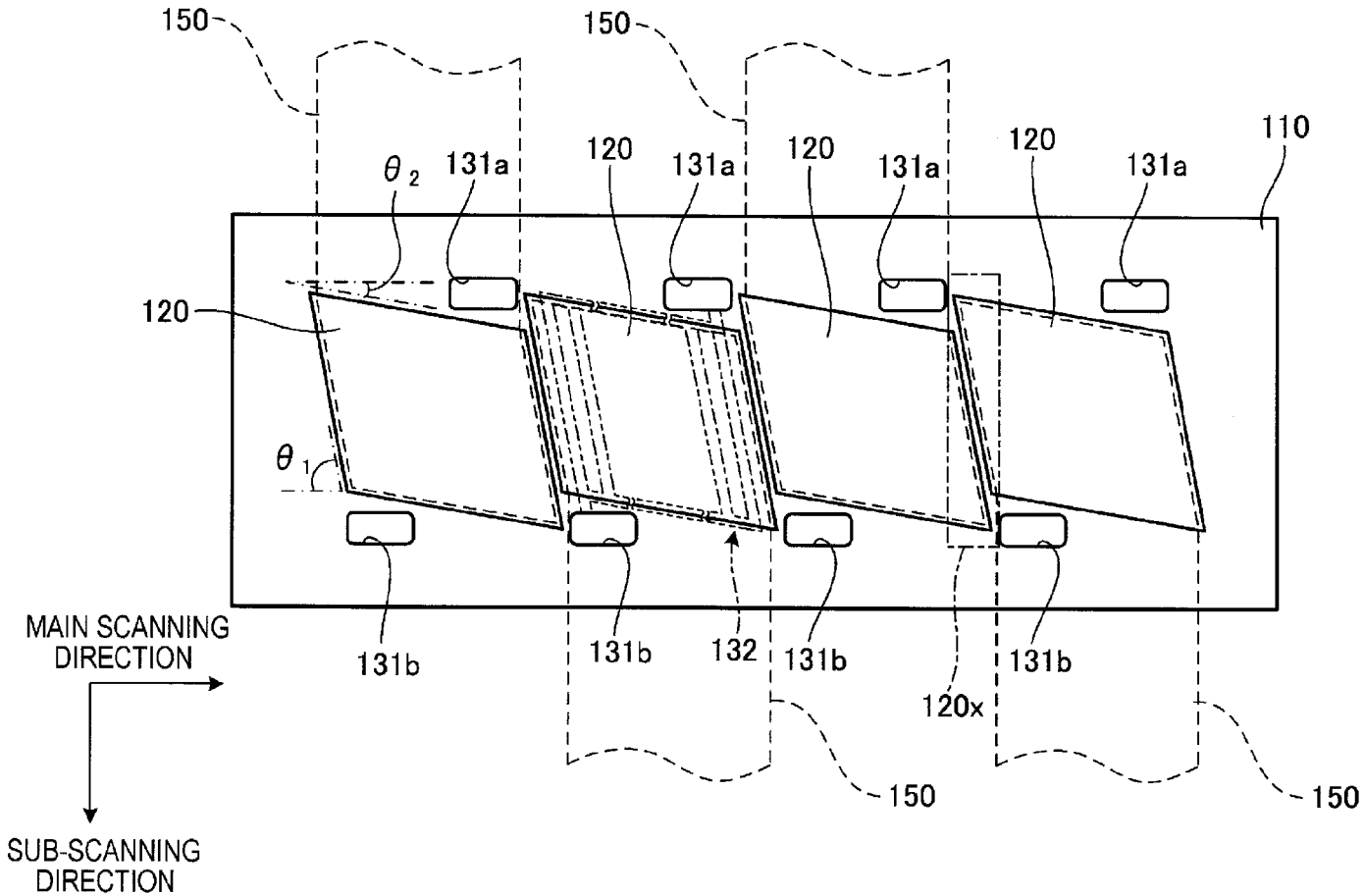
FIG. 2 is a plan view of a flow path unit configuring a lower structure of the inkjet head of FIG. 1.

The respective actuator units 120 have the same size and have a congruent parallelogram. Each side of the actuator unit 120 is inclined to the main scanning direction. Specifically, one sides of the actuator unit 120 form an acute angle $\theta 1$ with the main scanning direction and the other sides form an angle $\theta 2$ ($<\theta 1$). Hereinafter, the former sides in the left and right directions of FIG. 2 are respectively referred to as the 'left side' and the 'right side' and the latter sides in the upper and lower directions of FIG. 2 are respectively referred to as the 'upper side' and the 'lower side.' In an illustrative embodiment, $\theta 1$ and $\theta 2$ may be selected to satisfy the relationships: tan $\theta 1$=unit distance of 50 dpi/unit distance of 1200 dpi=24; and tan $\theta 2$=unit distance of 100 dpi/unit distance of 25 dpi=0.25.

The flow path unit 110 has a substantially rectangular parallelepiped shape and has a laminated structure including a plurality of plates 111 to 115 adhered to each other. On an upper surface thereof, ink supply ports 131 and pressure chambers 141 are opened. In the flow path unit 110, supply flow paths 132 are formed. The supply flow path 132 allows the supply ports 131 of the upper surface and the ejection ports 109 of the lower surface to communicate with each other and is configured by common flow paths 133, branch flow paths 134 and individual ink flow paths 140 from the upstream side. The lower surface of the flow path unit is the ejection surface 100*a* through which the ink is ejected, and the plurality of ejection ports 109 are opened.

The supply ports 131*a*, 131*b* of the upper surface are supplied with the ink from the upper structure. The supply ports 131 are opened while avoiding the arrangement areas of the actuator units 120 and are provided by a pair for each of the actuator units 120. The supply ports 131*a* are arranged near an area between the upper sides of the parallelogram areas and an upper end of the flow path unit 110 in FIG. 2 with respect to the sub-scanning direction and near obtuse angle parts of the parallelogram areas. The supply ports 131*b* are positioned between a lower end of the flow path unit 110 and obtuse angle parts of the lower sides of the parallelogram areas, thereby configuring the same arrangement relation as the supply ports 131*a*. As shown in FIG. 2, one pair of the supply ports 131*a*, 131*b* are arranged in vacant areas which are formed due to the inclination of the actuator unit 120 with respect to the main scanning direction, and is substantially symmetric about a center of the parallelogram area.

Figure 5:
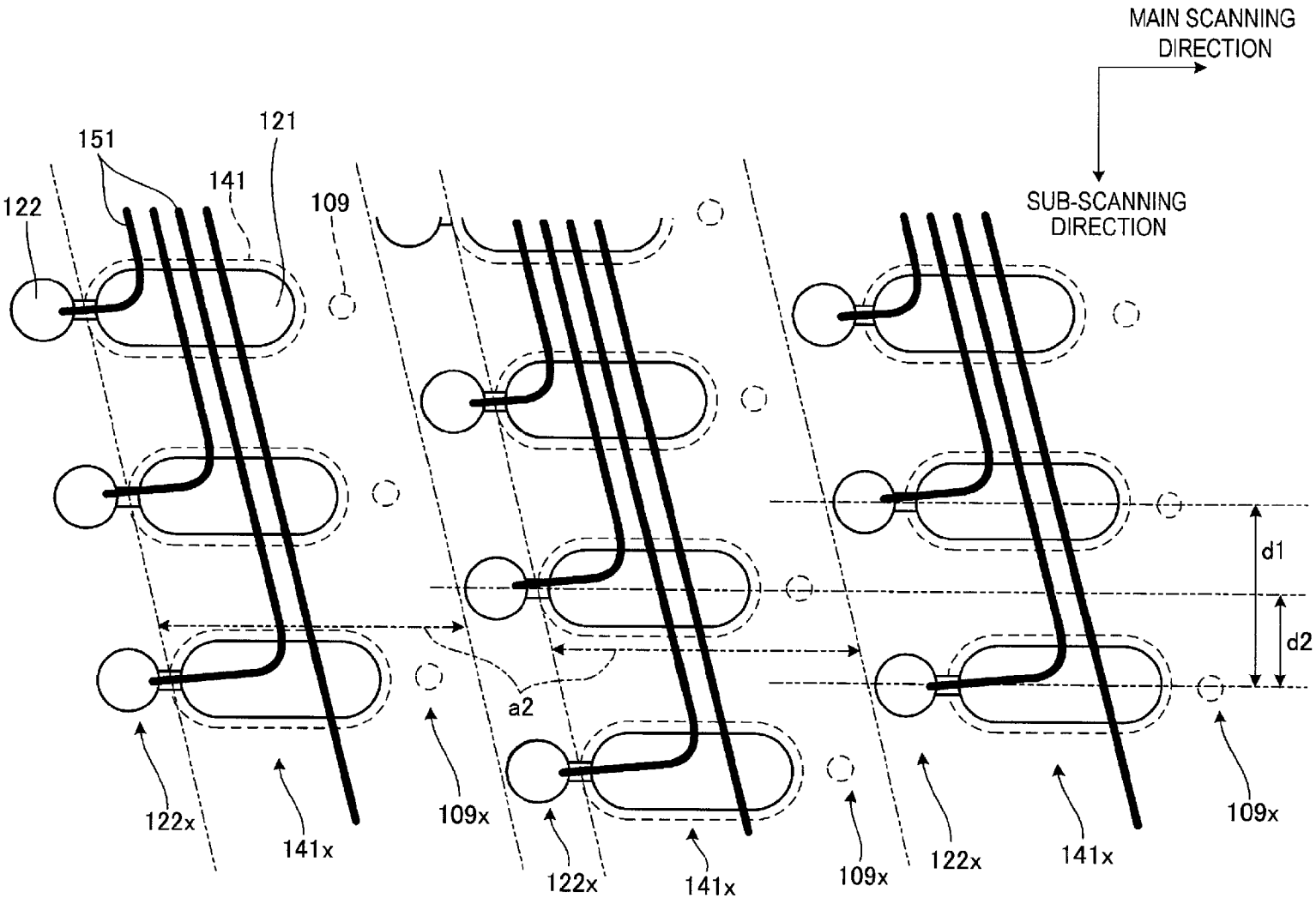
FIG. 5 is an enlarged plan view of driving signal lines provided in an actuator unit and an FPC, wherein the driving signal lines are shown partially.

The pressure chamber 141 of the upper surface is a hole which penetrates the plate 111 and configures a middle part of the individual ink flow path 140. As shown in FIG. 5, the pressure chamber 141 has a substantially rectangular shape having a longitudinal direction (first direction) in the main scanning direction (second direction) and curved corners. The pressure chambers 141 are arranged in a matrix form and configure four pressure chamber groups. Each pressure chamber group occupies the parallelogram area and vertically overlaps with the actuator unit 120. In the pressure chamber groups, the plurality of pressure chambers 141 configure pressure chamber columns 141*x* along the left side of the parallelogram area, and the plurality of pressure chamber columns 141*x* are arranged at an equal interval in the main scanning direction. A pressure chamber 141 is positioned between two pressure chambers 141 adjacent to each other in an adjacent pressure chamber column 141*x*, with respect to the direction along the pressure chamber column 141*x*. In this illustrative embodiment, as shown in FIG. 5, d1=2×d2. The pressure chamber 141 is positioned at an equal distance (at the center of an interval) to the two pressure chambers 141 in the adjacent pressure chamber column 141*x*. Thereby, an influence of crosstalk becomes uniform.

Figure 3:
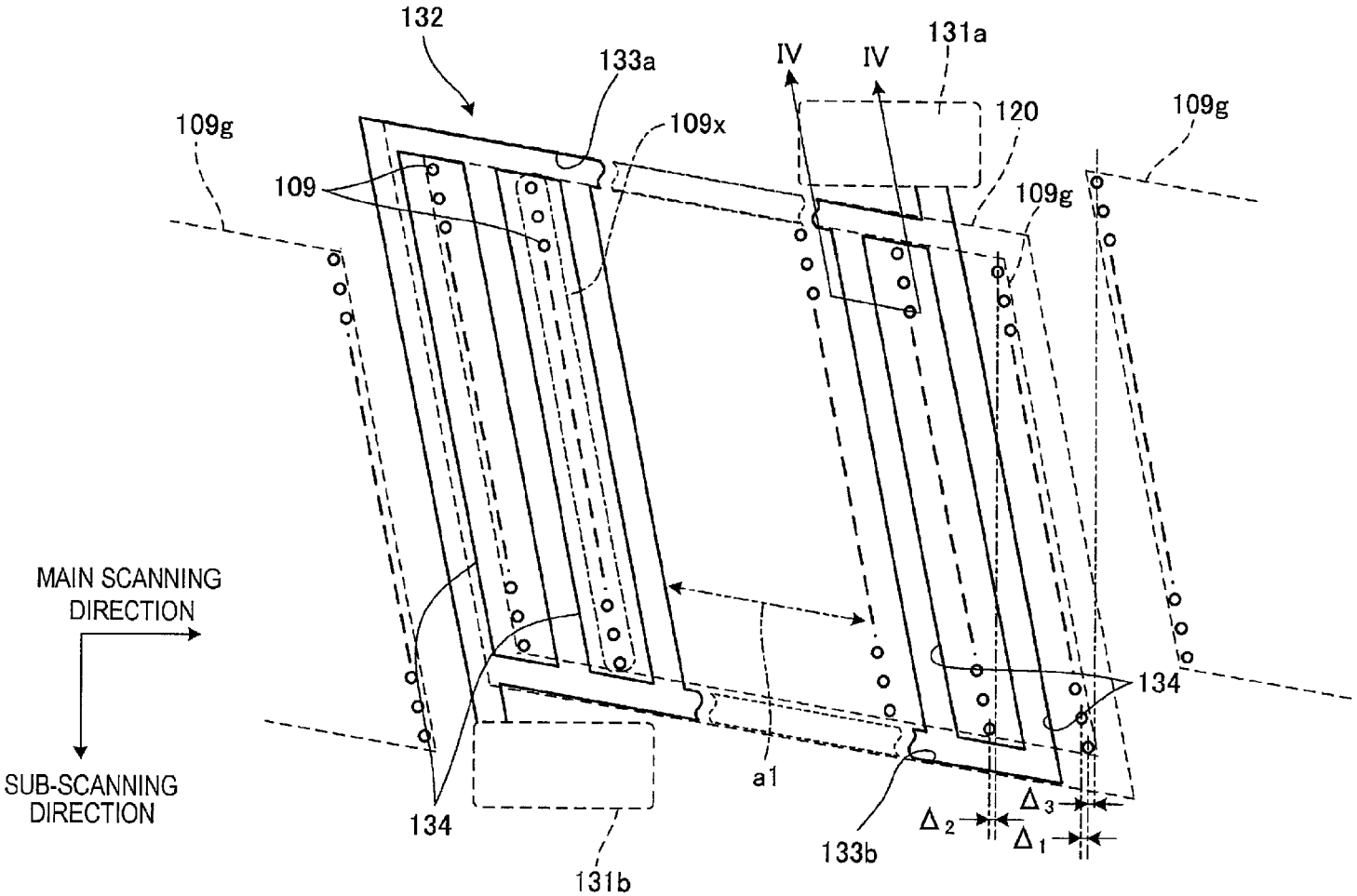
FIG. 3 is a plan view showing a positional relation between a supply flow path and ejection ports formed in the flow path unit of FIG. 2.

As shown in FIGS. 2 and 3, the internal supply flow path 132 communicates with the supply ports 131*a*, 131*b*. As shown in FIG. 3, the supply flow path 132 has a common flow path 133*a* extending along the upper side of the actuator unit 120 and a common flow path 133*b* extending along the lower side thereof. The common flow paths 133*a*, 133*b* communicate with the supply ports 131*a*, 131*b* near the obtuse angle parts of the parallelogram area, respectively. The common flow path 133*a* and the common flow path 133*b* are connected by the plurality of branch flow paths 134. The branch flow paths 134 linearly extend along the pressure chamber columns 141*x* and are arranged at an equal interval in the main scanning direction. The pressure chamber column 141*x* and an ejection port column (which will be described later) 109*x* are positioned in the main scanning direction between the two branch flow paths 134. The branch flow paths 134 partially overlap with the pressure chambers 141 vertically while avoiding the ejection ports 109.

Figure 4:
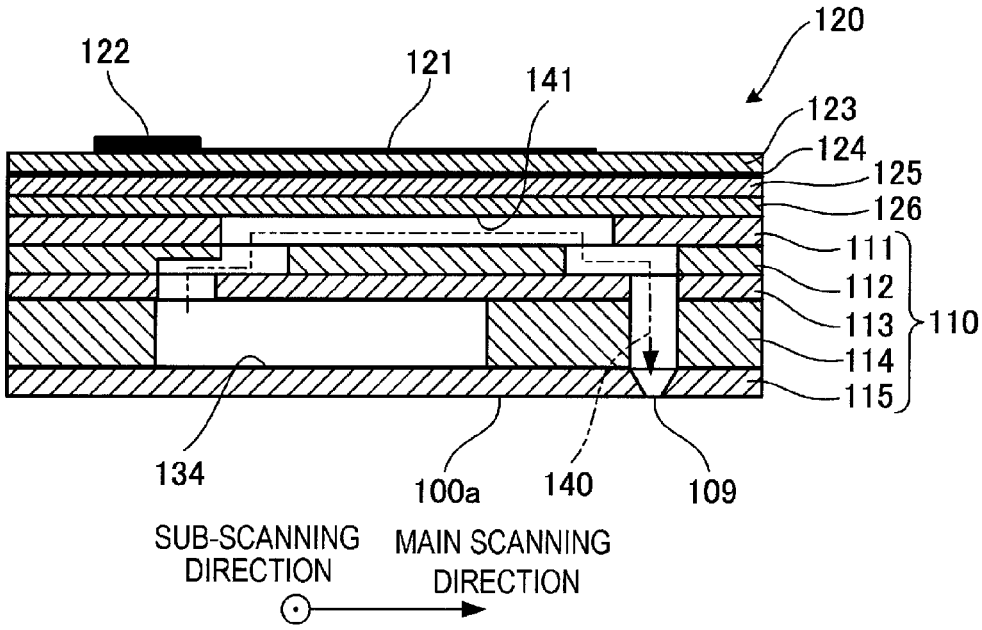
FIG. 4 is a sectional view of the flow path unit taken along a line of IV-IV of FIG. 3.

As shown in FIG. 4, an exit port of the branch flow path 134 is connected with the plurality of individual ink flow paths 140. In this illustrative embodiment, the one pressure chamber column 141*x* shares the one branch flow path 134 by the individual ink flow paths 140. The individual ink flow paths 140 distribute the ink of the branch flow path 134 to the ejection ports 109. The individual ink flow path 140 is configured by an upstream side half part and a downstream side half part with the pressure chamber 141 being interposed therebetween. The upstream side half part connects the exit port and one end of the pressure chamber 141 and is formed in the plate 112 and the plate 113. The downstream side half part connects the other end of the pressure chamber 141 and the ejection port 109 and is formed in the plates 112 to 115.

As shown in FIG. 3, the ejection ports 109 of the lower surface (ejection surface 100*a*) are arranged in a matrix form and configure four ejection port groups 109*g*. Each ejection port group 109*g* occupies a similar area to the actuator unit 120 and is included within the actuator unit 120 when seen from a plan view. In the ejection port group 109*g*, the plurality of ejection ports 109 configures ejection port columns 109*x* along the left side of the parallelogram area, and the plurality of ejection port columns 109*x* is arranged at an equal interval in the main scanning direction. In one ejection port column 109*x*, the predetermined number of ejection ports 109 (for example, 48 ejection ports) is arranged at an equal interval. Meanwhile, although not shown, in an area a1 of FIG. 3, the pressure chamber columns 141*x*, the ejection port columns 109*x* and the branch flow paths 134 are arranged at an equal interval in the direction along the upper side of the parallelogram area, like the other areas. The ejection ports 109 are arranged at the same interval as the pressure chambers 141 in the main and sub-scanning directions.

Also, the ejection ports 109 are arranged at a predetermined interval corresponding to a printing resolution over an entire area of a printing width. In this illustrative embodiment, as shown in FIG. 3, the ejection ports 109 are arranged along the left side of the parallelogram from one end of the ejection port column 109*x* toward the other end with being shifted by a unit distance of the resolution in the main scanning direction (for example, by 21 μm when the resolution in the main scanning direction is 1200 dpi). The other end of the ejection port column 109*x* and one end of the adjacent ejection port column 109*x* are spaced by a unit distance in the main scanning direction. That is, an interval (for example, Δ1 of FIG. 3) between the ejection ports 109 in each ejection port column 109*x*, an interval (Δ2 of FIG. 3) between the ejection ports 109 adjacent to each other over the two different ejection port columns 109*x* and an interval (Δ3 of FIG. 3) between the ejection ports 109 adjacent to each other over the two different ejection port groups 109*g* are the same. In the meantime, the pressure chambers 141 also have the same arrangement shape as the ejection ports 109.

As shown in FIG. 4, the actuator unit 120 has a laminated structure mainly having three piezoelectric layers 123 to 125. The piezoelectric layers are sheet-type members configured by PZT (piezoelectric zirconate titanate)-based ceramics having ferroelectricity. Only the piezoelectric layer 123 is a layer positioned vertically between electrodes and is polarized in the same direction as the laminating direction of the laminated structure. A piezoelectric layer 126 seals the pressure chambers 141 and defines ceiling surfaces of the pressure chambers 141. The piezoelectric layers 123, 125, 126 define the parallelogram area of one actuator unit 120 and are provided over all the pressure chambers 141 facing the parallelogram area.

Individual electrodes 121 are formed to face the pressure chambers 141 on an upper surface of the piezoelectric layer 124. The individual electrode 121 occupies the substantially same parallelogram area as the pressure chamber 141, when seen from a plan view. As shown in FIG. 5, the individual electrode 121 is substantially similar to the pressure chamber 141 and has a smaller size than the pressure chamber. The individual electrode 121 has the same longitudinal direction as the pressure chamber 141 and shares a center with the pressure chamber. The individual electrode 121 has an extension end at an opposite side to the ejection port 109 and is connected to a land 122 (connection part) at a distal end thereof. The land 122 has a cylindrical shape. The lands 122 have the same arrangement shape as the ejection ports 109 and configure four land groups. In the land groups, the plurality of lands 122 are arranged at an equal interval along the left side of the parallelogram, thereby forming land columns 122*x*. The plurality of land columns 122*x* is arranged in the main scanning direction. As a whole, the lands 122 are arranged in the same matrix form as the ejection ports 109. Hereinafter, an area which is formed along the land column 122*x* and between the adjacent land columns 122*x* is referred to as a band-shaped area a2 (refer to FIG. 5).

As shown in FIG. 4, a common electrode 124 is formed between the piezoelectric layer 123 and the piezoelectric layer 125. The common electrode 124 is integrally formed over the overall planar area of one actuator unit 120. The common electrode 124 is grounded in an area which is not shown.

The individual electrode 121 and the common electrode 124 are made of Au (gold). The land 122 is made of conductive material such as Ag—Pd (silver/palladium), Au (gold), Ag (silver) and the like. For example, the land may be made of Ag—Pd.

A part of the piezoelectric layer 123 positioned between both electrodes 121, 124 is an active part, which is spontaneously deformed when an electric field is applied thereto. In the meantime, the piezoelectric layers 125, 126 which are not polarized are non-active parts, which are not spontaneously deformed by the applying of the electric field. Here, when the individual electrode 121 becomes a potential different from the ground, the active part grows in a thickness direction by the electric field and shrinks in a plane direction. Since the non-active parts are not spontaneously deformed, a distortion difference is caused between the active part and the non-active parts. At this time, a part positioned between the individual electrode 121 and the pressure chamber 141 is deformed (unimorph deformation) in a convex shape toward the pressure chamber 141. The deformation is independent for each of the individual electrodes 121. That is, the actuator unit 120 is formed with the plurality of actuators which can be individually driven. Here, when the actuator is deformed, the energy is applied to the ink in the pressure chamber 141. When the energy has a predetermined level or higher, the ink is ejected from the ejection port 109. That is, each actuator selectively applies the ejection energy to each pressure chamber 141.

As shown in FIG. 5, each land 122 is connected with one driving signal line 151. The driving signal line 151 electrically connects the land 122 to an output terminal of the driver IC by a wiring in the FPC 150. Each driving signal line 151 is drawn out rightward from the land 122 in FIG. 5, is bent upward along the longitudinal direction of the band-shaped area a2 and is drawn out toward one end of the band-shaped area a2. In one band-shaped area a2, the plurality of driving signal lines 151 from one land column 122*x* are arranged. The controller 1*p* outputs a control signal based on image data to the driver IC. The driver IC selectively supplies a driving signal based on the control signal to the driving signal lines 151. When the driving signal is supplied to the individual electrodes 121, the ejection energy is applied to the ink in the pressure chambers 141, so that the ink is ejected from the ejection ports 109.

According to this illustrative embodiment, the longitudinal directions of the pressure chambers 141 are aligned with the longitudinal direction (main scanning direction) of the flow path unit 110. Therefore, since the flow path unit 110 can become compact in the sub-scanning direction, as a whole, the compact printer 1 is realized.

Also, as the longitudinal directions of the pressure chambers 141 are aligned with the longitudinal direction of the flow path unit 110, the driving signal lines 151 can be appropriately arranged, as described below. Since the driving signal lines 151 are respectively connected to the lands 122, the driving signal lines should pass to an area between the lands 122, when seen from a plan view.

In the meantime, the land 122 is arranged near the pressure chamber 141. Accordingly, when the longitudinal direction of the pressure chamber 141 is aligned with the longitudinal direction of the flow path unit 110, the arrangement interval of the lands 122 in the main scanning direction can be correspondingly made to be larger than the arrangement interval in the sub-scanning direction. Thereby, as shown in the band-shaped area a2 of FIG. 5, the area between the lands 122 can widen the width in the main scanning direction. Therefore, it is possible to arrange the plurality of driving signal lines 151 by drawing out the driving signal lines 151 in the longitudinal direction of the band-shaped area a2.

Further, the FPC 150 is also drawn out from the actuator unit 120 in the sub-scanning direction. In the meantime, if the FPC 150 is drawn out in the main scanning direction, since the FPC 150 interferes with the upper structure of the head 100 positioned at the upper part, it is not easy to perform an aligning operation for connection to the circuit substrate. In contrast, according to this illustrative embodiment, when drawing out the FPC 150, it is possible to easily draw out the FPC 150 to the outside toward the sub-scanning direction while avoiding the upper structure, so that the aligning operation can be easy.

Also, the pressure chamber 141 is arranged such that the position thereof in the direction of the pressure chamber column 141*x* is located at the exact center of the interval between the adjacent pressure chambers 141 in the adjacent pressure chamber column 141*x*. Therefore, the pressure chambers 141 are relatively uniformly distributed in the plane area and the influence of the crosstalk from the pressure chambers 141 arranged around the corresponding pressure chamber 141 is uniform. That is, since the influence applied from the surrounding is uniform when each pressure chamber 141 performs the ejection operation, the ejection operation becomes stable.

Meanwhile, in this illustrative embodiment, the upper side and lower side of the actuator unit 120 are inclined with respect to the main scanning direction. In contrast, if the upper and lower sides are aligned with the main scanning direction, the actuator units 120 are shifted little by little in the sub-scanning direction, so that the overall width in the sub-scanning direction is increased. In contrast, in this illustrative embodiment, the actuator units 120 are arranged as described above, so that it is possible to arrange the actuator units at the same position with respect to the sub-scanning direction. Thereby, it is possible to arrange the actuator units 120 along the main scanning direction while the interval of the ejection ports 109 does not break off, so that the space of the planar area can be effectively used.

Figure 6:
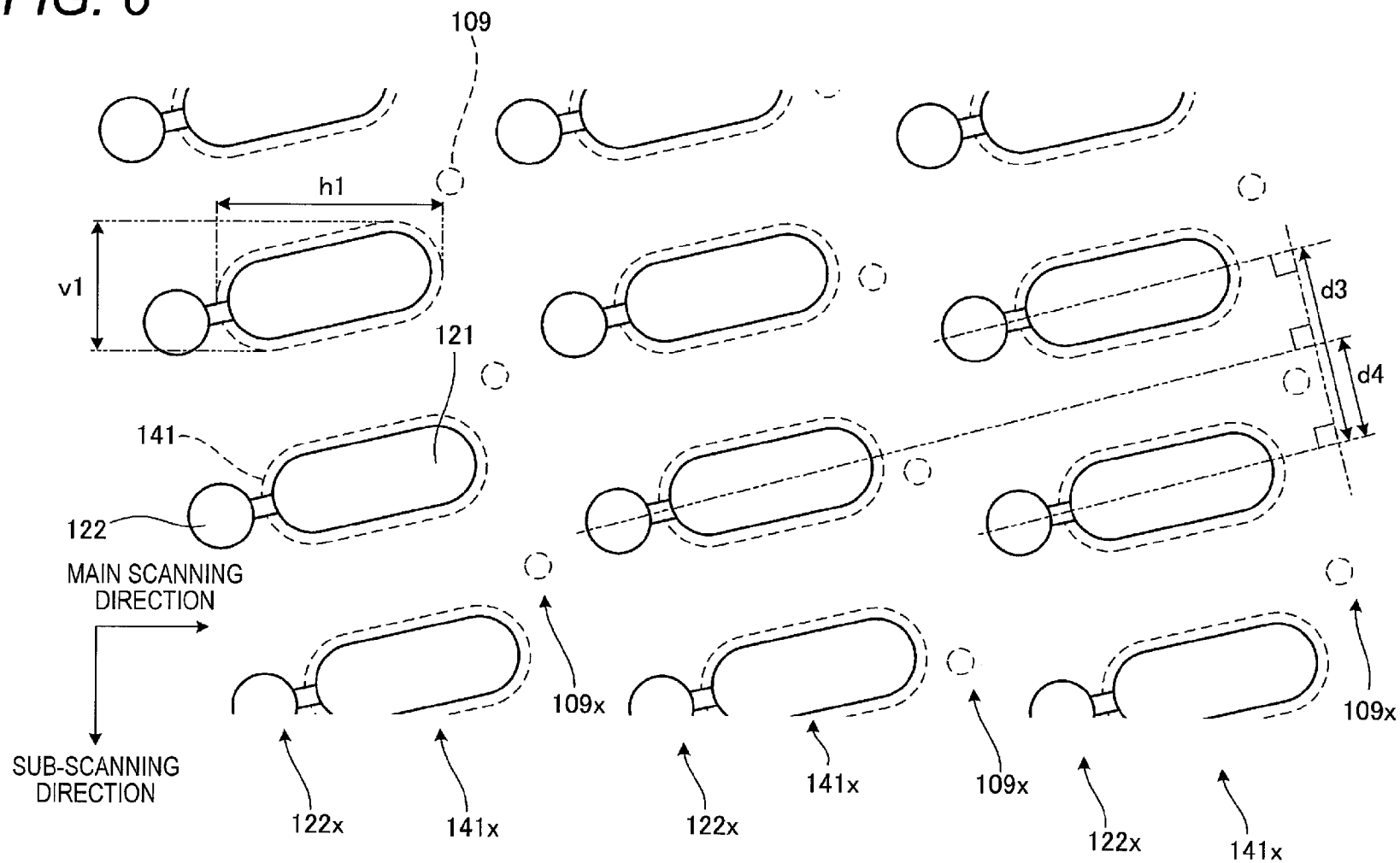
FIG. 6 is an enlarged plan view of an actuator unit according to a first modified illustrative embodiment in an arrangement mode of pressure chambers.

In the below, modified illustrative embodiments in the arrangement mode of the pressure chambers 141 are described. In a first modified illustrative embodiment, as shown in FIG. 6, the longitudinal direction of the pressure chamber 141 is orthogonal to the direction of the left side of the parallelogram. At this time, a length h1 of the pressure chamber 141 in the main scanning direction is larger than a length v1 of the pressure chamber 141 in the sub-scanning direction. By arranging the pressure chambers as described above, the head 100 becomes compact, as a whole, like the above illustrative embodiment. The arrangement relation of the ejection ports 109 is the same as the above illustrative embodiment. Also, like the above illustrative embodiment, each pressure chamber 141 is arranged such that the position thereof in the direction of the pressure chamber column 141$x$ is located at the exact center of the interval between the adjacent pressure chambers 141 in the adjacent pressure chamber column 141$x$. That is, the pressure chambers are arranged such that a distance d3 becomes the double of a distance d4 in FIG. 6.

Figure 7A:
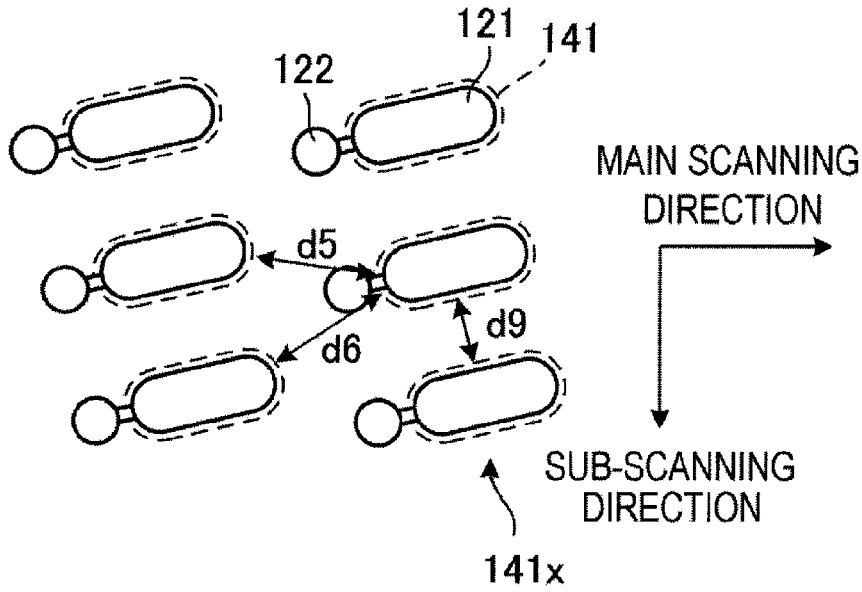
FIG. 7A is a plan view showing an arrangement relation of individual electrodes according to the first illustrative modified embodiment.
Figure 7B:
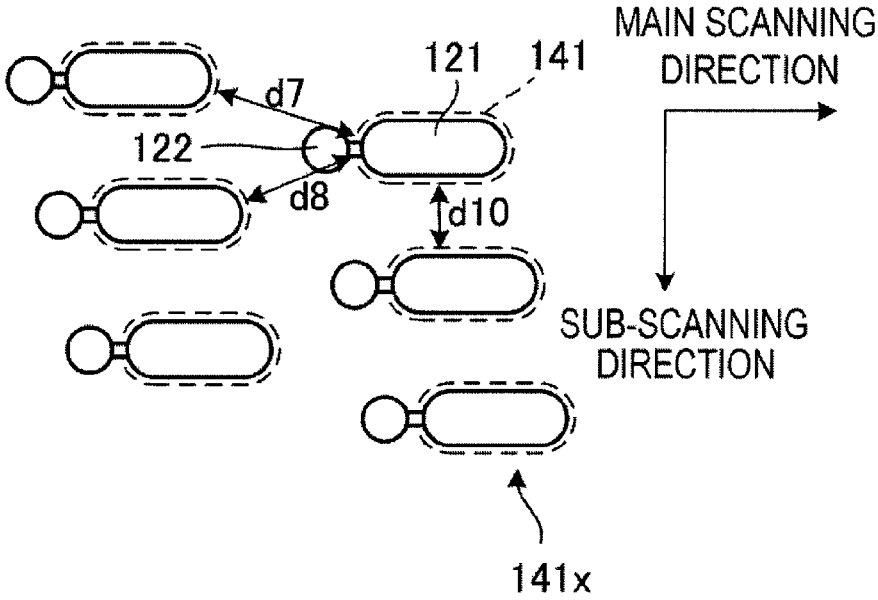
FIG. 7B is a plan view showing an arrangement relation of individual electrodes according to the illustrative embodiment shown in FIG. 5.

Therefore, in the first modified illustrative embodiment, as described below, the pressure chambers 141 are arranged more uniformly, compared to the above illustrative embodiment. FIGS. 7A and 7B show the first modified illustrative embodiment and the above illustrative embodiment, respectively. Regarding the distances of the pressure chamber 141 to the adjacent different pressure chambers 141 in the main scanning direction, a relation of about d5=d6 is satisfied in the first modified illustrative embodiment. However, in the above illustrative embodiment, d7>d8. Like this, when the distances between the pressure chambers 141 are different, the influence of the crosstalk occurring between the pressure chambers 141 becomes non-uniform, so that the ejection characteristics may be non-uniform. In contrast, according to the first modified illustrative embodiment, the pressure chambers are arranged such that distances between the pressure chambers 141 are uniform. Therefore, the influence of the crosstalk is also uniform, so that the ejection characteristics are uniform.

Also, when it is assumed that the arrangement shape of the lands 122 and the shapes and sizes of the pressure chambers 141 are not changed in the pressure chamber column 141$x$, the distance between two adjacent pressure chambers 141 in the pressure chamber column 141$x$ is largest in the first modified illustrative embodiment. For example, a distance d9 between the pressure chambers 141 in FIG. 7A is larger than a distance d10 between the pressure chambers 141 in FIG. 7B. Accordingly, when it is assumed that the width of the pressure chamber 141 is constant, the distance between the pressure chambers 141 is largest in the first modified illustrative embodiment and the influence of the crosstalk in the direction of the left side of the parallelogram can be reduced. To the contrary, from a standpoint of suppressing the influence of the crosstalk, the distance between the pressure chambers 141 can be made to be a predetermined size even though the width of the pressure chamber 141 is changed. At this time, in the first modified illustrative embodiment, the width of the pressure chamber 141 can be made to be largest. The larger the width of the pressure chamber 141, the higher the efficiency of the ejection operation. Hence, according to the first modified illustrative embodiment, it is possible to realize the more efficient pressure chamber 141.

Figure 8:
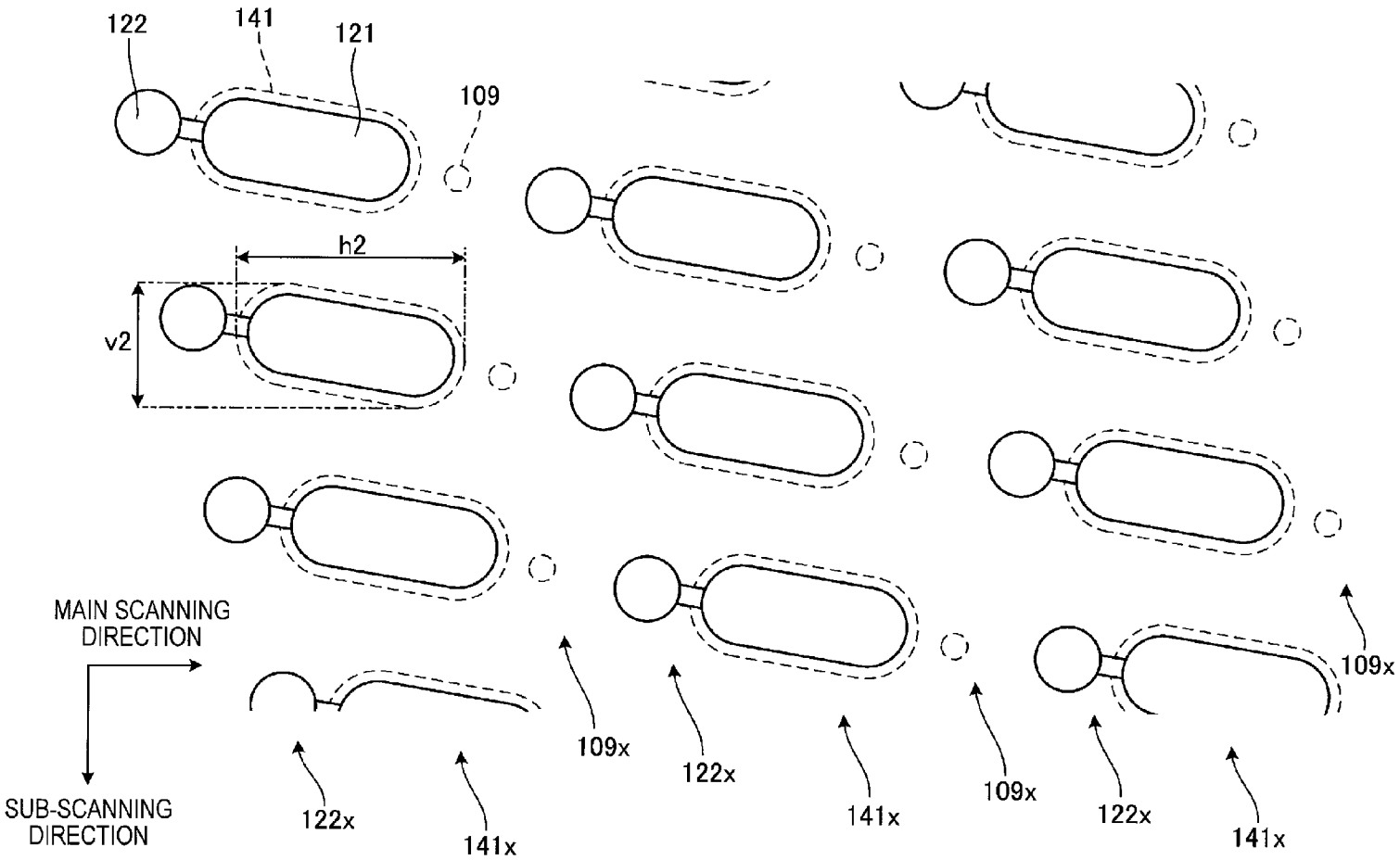
FIG. 8 is an enlarged plan view of an actuator unit according to a second modified illustrative embodiment in an arrangement mode of the pressure chambers.

In a second modified illustrative embodiment, as shown in FIG. 8, the longitudinal direction of the pressure chamber 41 is aligned with the direction of the upper side of the parallelogram. The arrangement relation of the ejection ports 109 is the same as the above illustrative embodiment. At this time, a length h2 of the pressure chamber 141 in the main scanning direction is larger than a length v2 of the pressure chamber 141 in the sub-scanning direction. By arranging the pressure chambers as described above, the head 100 becomes compact, as a whole, like the above illustrative embodiment.

While the present invention has been shown and described with reference to certain illustrative embodiments thereof, it will be understood by those skilled in the art that various changes in form and details may be made therein without departing from the spirit and scope of the invention as defined by the appended claims.

For example, in the above illustrative embodiments, four actuator units 120 and four ejection port groups 109$g$ corresponding to the actuator units are provided for each head 100. However, the number thereof may be eight, for example.

In the above illustrative embodiments, each set of the land 122, the pressure chamber 141 (individual electrode 121) and the ejection port 109 is arranged in same order of the land 122, the pressure chamber 141 (individual electrode 121) and the ejection port 109. However, a set in which the land, the pressure chamber and the ejection port are arranged in the reverse order may be included.

The liquid ejection head according to illustrative embodiments of the present invention can be applied to a liquid ejection apparatus such as facsimile and copier without limiting to the printer. Also, the number of the liquid ejection heads which are applied to the liquid ejection apparatus is not limited to four. That is, one or more liquid ejection heads may be provided. The liquid ejection head is not limited to the line type and may be a serial type. Furthermore, the liquid ejection head may eject liquid other than ink.

What is claimed is:

1. A liquid ejection head comprising:

a flow path unit which includes:

a plurality of liquid ejection ports arranged in a matrix form in a two-dimensional area of a parallelogram; and a plurality of pressure chambers communicating with the plurality of liquid ejection ports, respectively, and each pressure chamber being long in a first direction, wherein the flow path unit is long in a second direction, wherein the second direction comprises a main scanning direction, wherein each of the pressure chambers has a length in the second direction larger than a length in a direction orthogonal to the second direction, and wherein the plurality of pressure chambers are arranged in a matrix form in a substantially same area as the two-dimensional area.

2. The liquid ejection head according to claim 1, wherein the plurality of pressure chambers configure a plurality of pressure chamber columns along one of sides of the parallelogram, which has a larger acute angle with respect to the second direction.

3. The liquid ejection head according to claim 1, further comprising:

an actuator which includes:

a plurality of connection parts corresponding to the plurality of pressure chambers; and a plurality of individual electrodes electrically connected to the connection parts, respectively, and arranged to face the pressure chambers, respectively, wherein the actuator is configured to apply ejection energy to liquid in a pressure chamber facing an individual electrode when a driving signal is supplied to the individual electrode from a corresponding connection part; and a plurality of driving signal lines connected to the connection parts, respectively, wherein the plurality of connection parts configure a plurality of connection part columns along one of sides of the parallelogram, which has a larger acute angle with respect to the second direction, and are arranged in a matrix form having an arrangement interval in the second direction larger than that in the direction orthogonal to the second direction, and wherein the plurality of driving signal lines are drawn out, in a band-shaped area extending along the one of the sides between adjacent connection part columns, from the connection parts toward one end of the band-shaped area in a longitudinal direction of the band-shaped area.

4. The liquid ejection head according to claim 3, wherein a plurality of the two-dimensional areas are provided, and wherein a flexible printed circuit having the plurality of driving signal lines is drawn out from each of the two-dimensional areas along the direction orthogonal to the second direction.

5. The liquid ejection head according to claim 4, wherein the plurality of two-dimensional areas are arranged such that the two-dimensional areas have the same position in the direction orthogonal to the second direction and are spaced at an equal interval in the second direction and sides thereof are parallel with each other.

6. The liquid ejection head according to claim 1, wherein the first direction is parallel with the second direction.

7. The liquid ejection head according to claim 1, wherein the first direction is orthogonal to one of sides of the parallelogram, which has a larger acute angle with respect to the second direction.

8. The liquid ejection head according to claim 1, wherein the first direction is parallel with one of sides of the parallelogram, which has a smaller acute angle with respect to the second direction.

9. The liquid ejection head according to claim 2, wherein in a direction along the one of sides of the parallelogram, a pressure chamber included in one of the pressure chamber columns is arranged at a center position of an interval between pressure chambers adjacent to each other included in a pressure chamber column adjacent to the one of the pressure chamber columns.

10. The liquid ejection head according to claim 1, wherein all sides of the parallelogram are inclined with respect to the second direction.

11. The liquid ejection head according to claim 1, wherein the plurality of liquid ejection ports are arranged at an equal interval in the second direction.

* * * * *